US006616463B1

(12) United States Patent
Burnett et al.

(10) Patent No.: US 6,616,463 B1
(45) Date of Patent: Sep. 9, 2003

(54) METHOD AND APPARATUS FOR SOLDER SPLICING AND GROUNDING COAXIAL CABLES

(75) Inventors: Jason Burnett, Toledo, OH (US); Michael C. Iannaccone, Ysilanti, MI (US); Toshitaka Tezuna, Novi, MI (US)

(73) Assignee: Yazaki North America, Canton, MI (US)

( * ) Notice: Subject to any disclaimer, the term of this patent is extended or adjusted under 35 U.S.C. 154(b) by 0 days.

(21) Appl. No.: 10/050,363

(22) Filed: Jan. 16, 2002

(51) Int. Cl.[7] ..... H01R 4/66
(52) U.S. Cl. ..... 439/98; 439/76.1; 174/40 CC
(58) Field of Search ..... 439/98, 76.1, 76.2, 439/402; 174/40 CC, 165 R, 88, 92

(56) References Cited

U.S. PATENT DOCUMENTS

| | | | | |
|---|---|---|---|---|
| 4,494,813 A | * | 1/1985 | Daley, Jr. et al. | 339/99 |
| 5,397,859 A | | 3/1995 | Robertson et al. | |
| 5,606,150 A | | 2/1997 | Radliff et al. | 174/92 |
| 5,746,610 A | * | 5/1998 | Shiu | 439/98 |
| 5,796,041 A | | 8/1998 | Suzuki et al. | |
| 6,111,201 A | | 8/2000 | Drane et al. | |
| 6,193,543 B1 | | 2/2001 | Howard et al. | |
| 6,238,246 B1 | | 5/2001 | Ferrill et al. | |
| 6,297,447 B1 | | 10/2001 | Burnett et al. | |

* cited by examiner

*Primary Examiner*—Alexander Gilman
(74) *Attorney, Agent, or Firm*—Young & Basile P.C.

(57) ABSTRACT

Two embodiments of a mechanism for splicing a coaxial radio cable to an antenna wire and grounding the braided outer conductor are disclosed. Both embodiments comprise an injection molded plastic box having two longitudinally spaced and independently operable snap lock covers and an insert molded metal grounding bracket which permits the device to be attached to, for example, an automobile body part. Within each box are locations for receiving an end-stripped coaxial cable and at least one end-stripped antenna wire in opposing alignment with the inner conductor of the coaxial cable so as to define a solder splice point. A soldering fork formed on the insert molded portion of the grounding bracket projects through the floor of the box into the interior thereof to serve as a solder point for the braided outer conductor of the coaxial cable. In the second embodiment an antenna grounding wire is also brought into the box and grounded to the soldering fork along with the braided inner conductor of the coaxial cable. A method comprising a sequence of cable and wire placements, cover closings and soldering steps is disclosed.

15 Claims, 10 Drawing Sheets

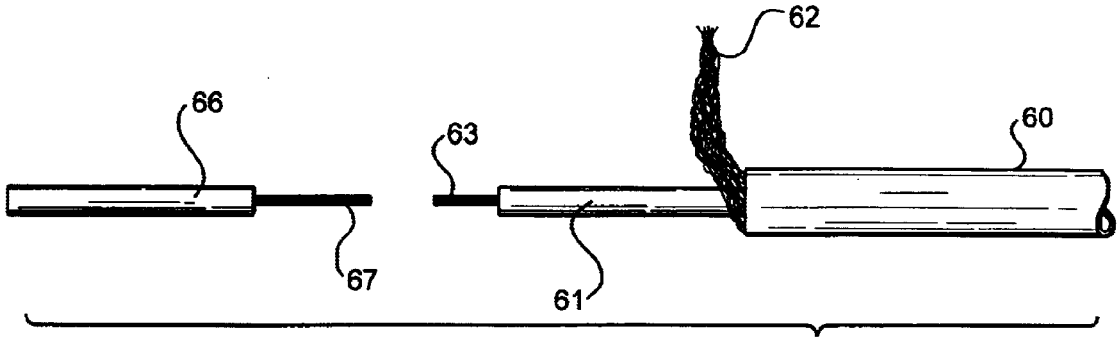
FIG - 3
FIG - 4
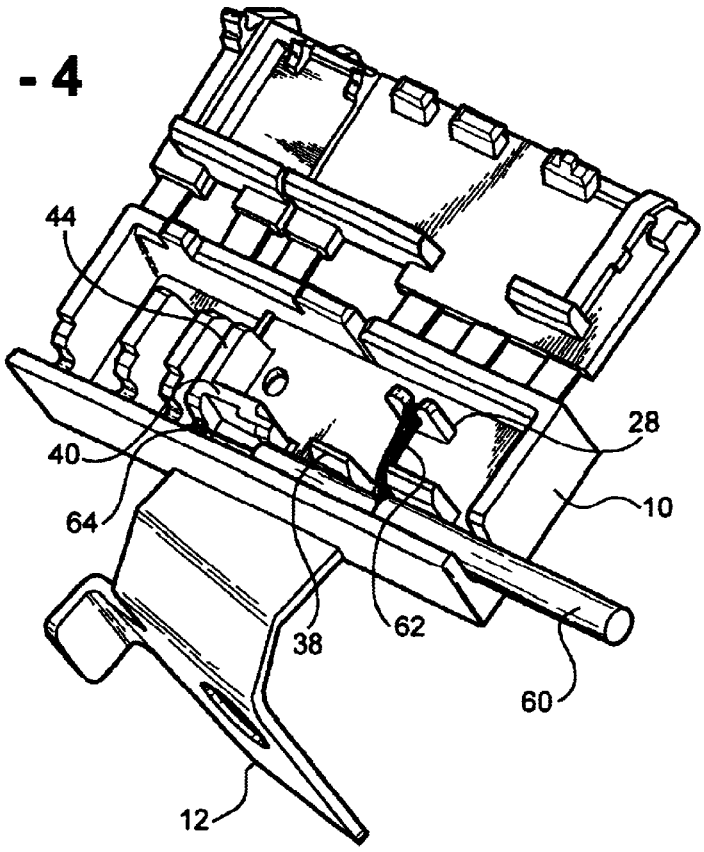

METHOD AND APPARATUS FOR SOLDER SPLICING AND GROUNDING COAXIAL CABLES

FIELD OF THE INVENTION

Our invention relates to a method for solder splicing one conductor of a coaxial cable to a second wire and, at essentially the same time, grounding the other conductor of the coaxial cable. Our invention also relates to a closure which facilitates the splicing/grounding method.

BACKGROUND OF THE INVENTION

The installation of a radio in an automotive vehicle typically involves the step of connecting an antenna wire to the inner conductor of a coaxial cable and grounding the braided outer conductor of the coaxial cable to the automobile body and frame. An accepted prior art technique involves the use of multiple crimping steps and the provision of protective plastic tubes as well as one or more soldering steps. Wires can be cut or damaged during the crimping operation and the soldering operation can result in electrical shorts.

SUMMARY OF THE INVENTION

Our invention simplifies the splicing of coaxial cable to wire as well as the grounding of the unspliced conductor of the coaxial cable. We provide a box-like closure of non conductive material, preferably injection molded plastic, having a floor, surrounding side walls and first and second covers which can be independently closed. A grounding bracket is combined with the closure such that a portion of the bracket projects through the closure floor to define the solder point for a grounding connection. The rest of the bracket is used to attach the closure to a vehicle body part. The covers are closed in sequence; the first cover is closed to hold the spliced wire prior to soldering and the second cover is closed after soldering to clamp and protect the coaxial cable.

According to our method, an end-stripped coaxial cable is placed in the closure, preferably press fit into one or more notches parallel to and proximate one of the side walls. The partially stripped braided outer conductor is pulled to one side and placed on an upstanding soldering member which is integral with the grounding bracket and which projects through the closure floor. At least part of the soldering member is preferably fork-shaped. An end-stripped insulated wire is also placed into the closure proximate and parallel to the side wall and in contacting alignment with the inner conductor of the coaxial cable. One of the two covers is closed on the wire to clamp it in place. Thereafter the wire and the inner conductor of the coaxial cable are soldered together and, at essentially the same time, the braided outer conductor of the coaxial cable is soldered to the upstanding soldering member. Thereafter the second cover is closed to clamp the coaxial cable in place.

Further in accordance with our invention we provide a closure for facilitating the method. The preferred closure comprises a plastic box with the embedded grounding bracket insert molded therewith. The covers are preferably hingedly attached to one side wall of the box in longitudinally spaced parallel positions. Each of the covers is preferably provided with a lateral extending clamping bar on the interior surface thereof. Means are formed integral with the box for defining coaxial cable and insulated wire receiving locations, these two locations being adjacent an outer longitudinal side wall and defined in the preferred embodiment by one or more notches and fork-shaped receiving areas. Also in the preferred embodiment an interior wall or partial wall is provided between the soldering points to reduce the likelihood of an inadvertent grounding connection between them. The soldering points are, therefore, laterally spaced and separated from one another by the interior wall.

As indicated above, the first or smaller of the two covers is preferably closed on the insulated wire to clamp it into position prior to soldering. The second cover is closed after the soldering operation to clamp the coaxial cable in place.

Our invention is described herein as applied to making an automotive antenna connection and may be used with both one and two wire antenna installations as hereinafter described in greater detail.

BRIEF DESCRIPTION OF THE DRAWINGS

The description herein makes reference to the accompanying drawings wherein like reference numerals refer to like parts throughout the several views, and wherein:

FIG. 3 shows a coaxial cable and antenna wire which have been end-stripped in preparation for splicing and grounding;

FIG. 4 shows the closure of FIG. 1 after an end-stripped coaxial cable has been placed in position within the closure;

DETAILED DESCRIPTION OF THE ILLUSTRATIVE EMBODIMENTS

Figure 1:
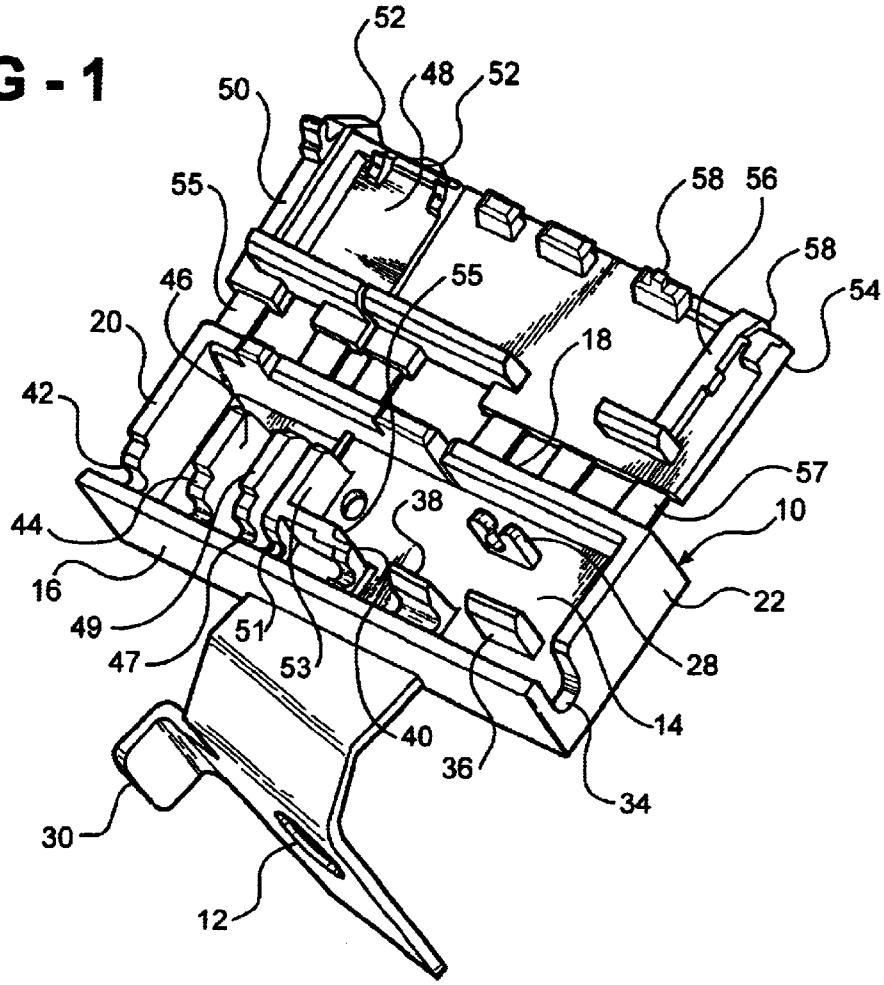
FIG. 1 is a perspective view of a closure/grounding bracket combination for splicing and grounding a coaxial cable to a single insulated antenna wire.
Figure 2:
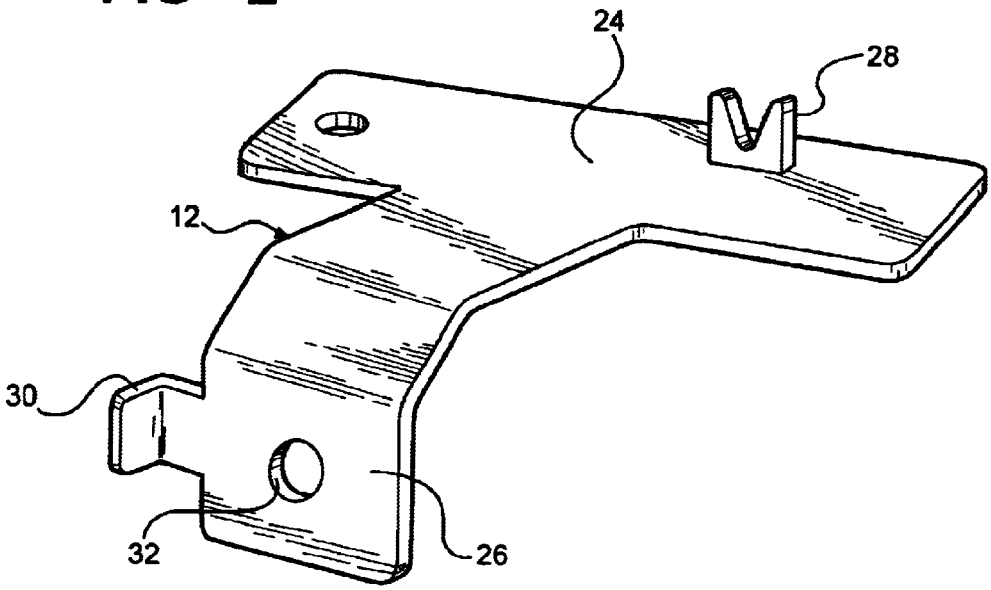
FIG. 2 is a perspective view of the grounding bracket portion of the FIG. 1 device prior to insert molding into the closure.

Referring now to FIGS. 1 and 2 there is shown a box-like molded plastic closure 10 with an insert molded conductive metal mounting and grounding bracket 12 projecting therefrom. The closure 10 has a floor 14, a first longitudinal side wall 16, a second longitudinal side wall 18, a first lateral side wall 20 and a second lateral side wall 22. The walls 14, 16, 18 and 20 are all generally of the same height and thickness.

The bracket 12 shown in detail in FIG. 2 is insert molded into the floor 14 of the closure 10 such that portion 24 is embedded in the floor. A bent tab 26 projects externally of the closure 10 and can be attached to an automobile body part by placing a bolt (not shown) through hole 32. An anti-rotation tab 30 prevents the bracket from turning with the bolt. An upstanding fork 28 is formed integrally with the embedded portion 24 and, as shown in FIG. 1, projects in an exposed fashion through the floor 14 into the interior of the closure 10.

The closure 10 is provided with snap-lock covers 48 and 54 which are connected to wall 18 by living hinges 55 and 57. Cover 48 has a lateral clamp bar 50 formed on the interior surface. Cover 54 has a lateral clamp 56 formed on its interior surface.

Closure 10 has a number of interior features which define (a) a location to receive an end-stripped coaxial cable 60 (FIG. 3); (b) a location to receive an end-stripped antenna wire 66, and (c) a soldering location defined by fork 28.

Referring to FIG. 3, the manner in which the coaxial cable 60 and antenna wire 66 are prepared is described. Cable 60 is first end-stripped to remove approximately 17 mm of the outer insulation to expose outer braided conductor 62 and inner insulator 61. Thereafter, about 4 mm of the inner insulator is removed to expose inner conductor 63. The braided conductor 62 is moved off to one side.

Antenna wire 66 is end-stripped to remove about 10 mm of insulation, thus exposing wire 67.

Referring to FIGS. 1 and 4, the location which receives the coaxial cable 60 is defined by a large notch 34 in wall 22, first and second interior walls or partitions 36 and 38 and a fork 40. Notch 34 is sized to snugly receive the unstripped portion of coaxial cable 60. Partition 36 is spaced from wall 16 to receive the cable 60; partition 38 is sized to receive the insulation 61 and fork 40 is sized to receive the stripped internal conductor 63. The space between partitions 36 and 38 permits the outer conductor to be placed in the solder fork 28.

Figure 5:
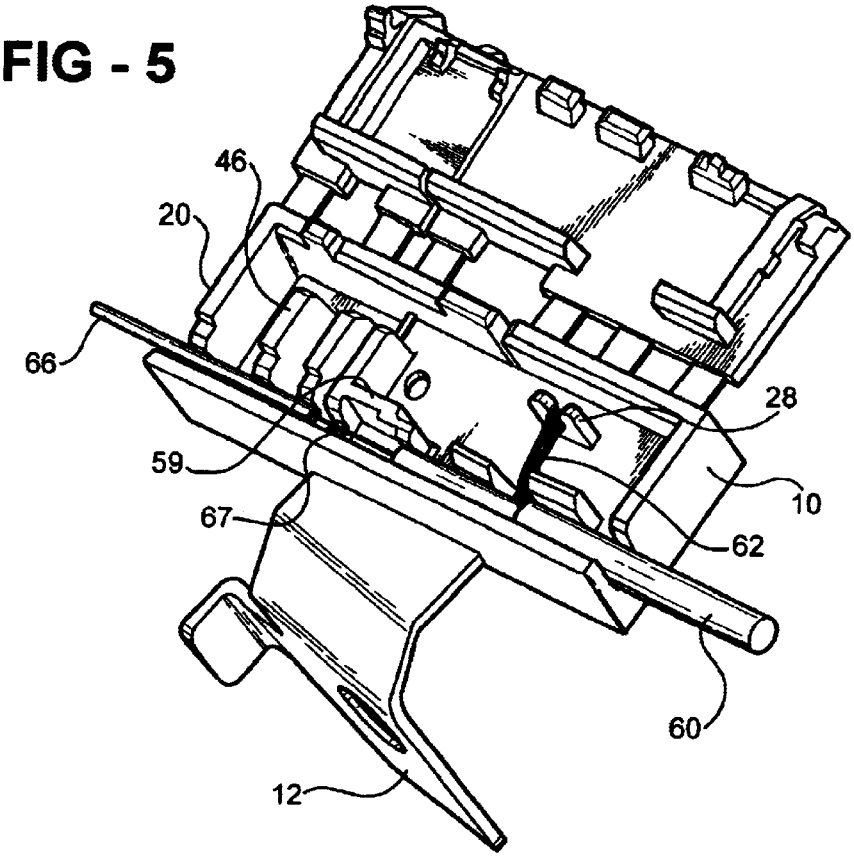
FIG. 5 is a perspective drawing of the FIG. 1 device after the antenna wire has been put in place.

Referring now to FIGS. 1 and 5, the location which receives antenna wire 66 is defined by a notch 42 in wall 20, a notch 44 in a lateral interior partition 46, a notch 47 in a partition 49, a notch 51 in a lateral interior partition 53 and, finally, by a longitudinal partition 59 between lateral partition 53 and fork 40.

The coaxial cable 60 is pressed into place in the first location as shown in FIG. 4 and the wire 66 is pressed into the second location as shown in FIG. 5. Once again the notches 42, 44, 47 and 51 are sized to receive the different diameter parts 66, 67 of the antenna wire and the wire 67 is layed over the inner conductor 63 in preparation for solder-splicing.

Figure 6:
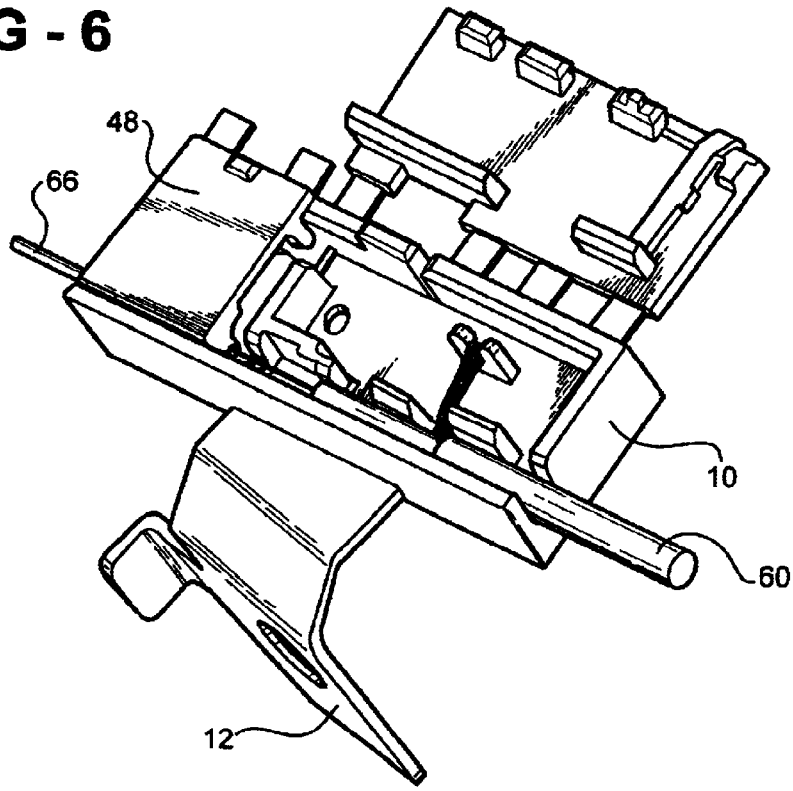
FIG. 6 is a view of the FIG. 1 device after the first of the two clamping covers is closed on the antenna wire.

As shown in FIG. 6 the next step is to close the cover 48 such that the clamping bar 50 lies across and in clamping relationship to the insulated portion of the wire 66 to hold the wire 66 in place for soldering. Snap lock tabs 52 on the cover 48 coact with the longitudinal side wall 16 and a small undercut on the interior surface thereof to lock the cover down and yet allow the cover to be pried open afterward.

Figure 7:
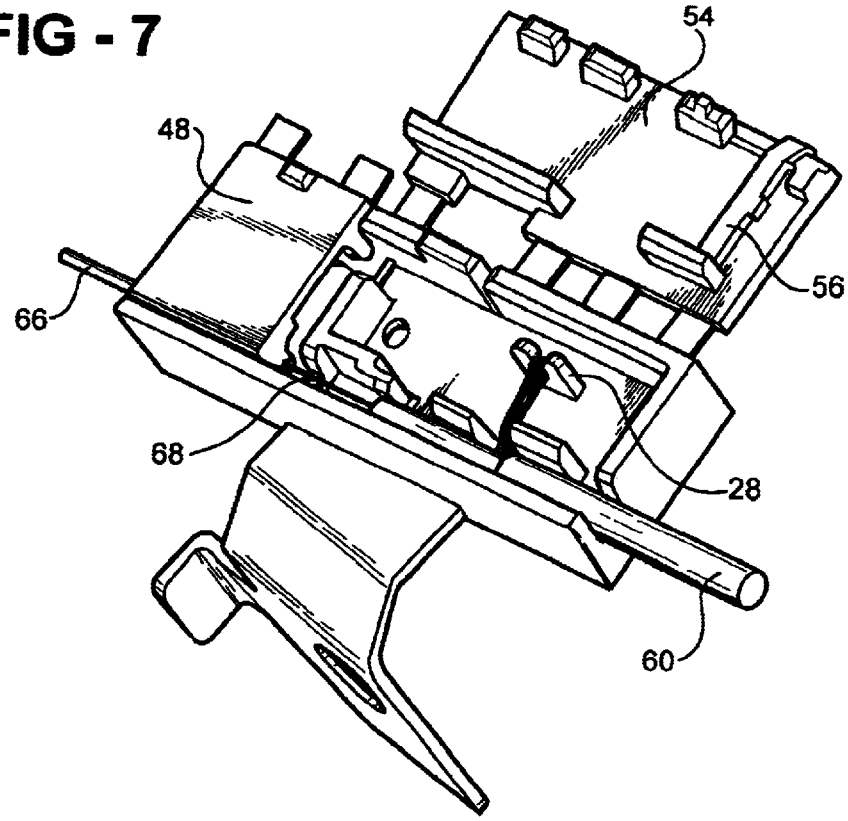
FIG. 7 is a view of the FIG. 1 device during the soldering operation.

The next step is shown in FIG. 7. This step involves applying solder at the splice point 68 between wall 16 and partition 59 where the wire 67 overlaps conductor 63. In addition, solder is applied at the grounding fork 28 with the cover 54 open to provide access.

Figure 8:
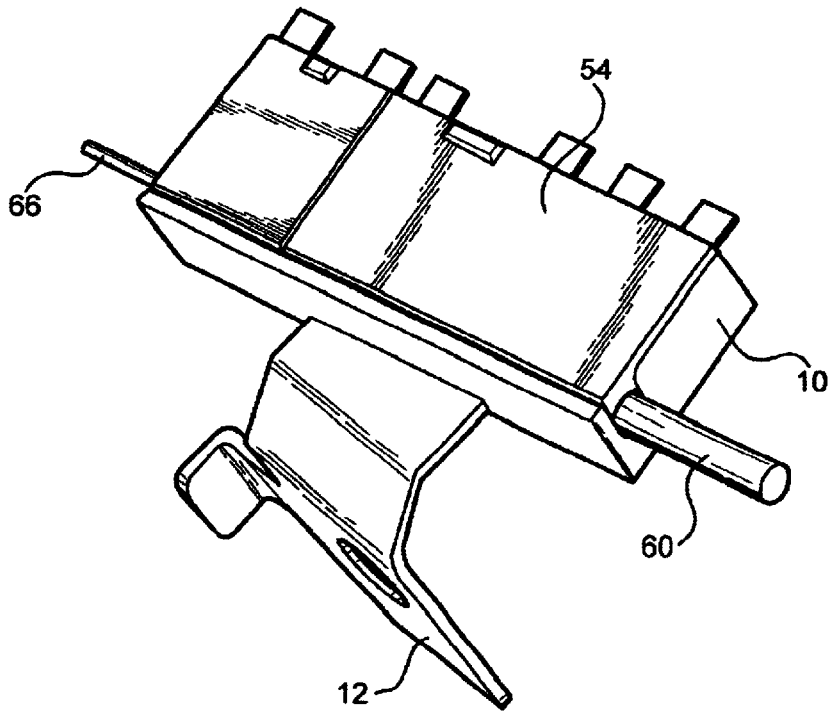
FIG. 8 is a view of the FIG. 1 device after the second cover has been closed.

FIG. 8 shows the final step of closing the cover 54 to bring the clamping bar 56 into clamping engagement with the outer insulated jacket of the coaxial cable 60 to secure the cable against undesirable tension on the solder points. The bracket 12 may then be installed on an automobile body to complete the grounding process.

Referring now to FIGS. 9–16 a second embodiment of the invention is shown to comprise a molded plastic closure 70 which is preferably injection molded from a suitable non-conducting material such as polyethylene. The closure 70 comprises a rectangular floor 72 with integral lateral end walls 74 and 76 and longitudinal side walls 78 and 80. Independently operable covers 82 and 84 are connected by living hinges 86 and 88 to the longitudinal side wall 80 so that they may be snap-locked across the closure 70 to close it at the appropriate time. The cover 82 carries interior clamping pegs 90, a transverse clamping bar 94 and snap lock nibs 92 which cooperate with an undercut on the opposite longitudinal wall 78 (interior) to provide, a snap lock feature. Cover 84 comprises clamp bar 96 and snap lock nibs 98 so that cover 84 may also be snap locked into place.

Figure 10:
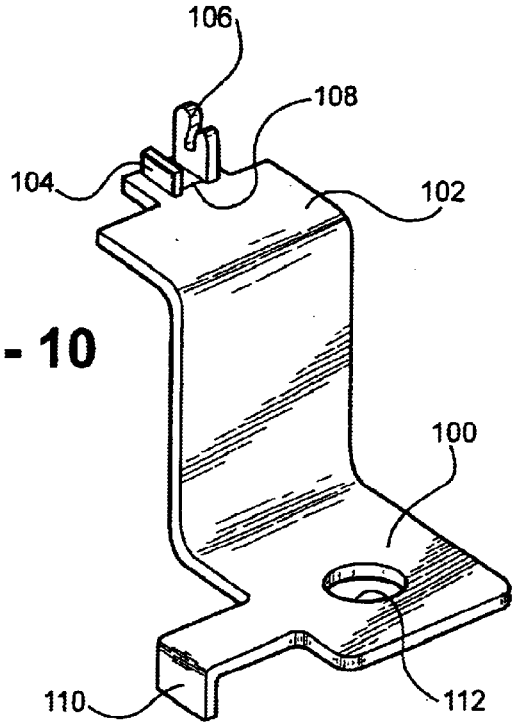
FIG. 10 is a perspective view of the grounding bracket portion of the FIG. 9 device prior to insert molding.

The closure 76 is provided with an insert molded conductive metal grounding bracket 100 having, as best shown in FIG. 10, an upper area 102 which is insert molded into the floor 72 of the closure 70. Solder point features 104 and 106 are upstanding from the area 102 along with a pedestal area 108 between the features 104 an 106 to serve as a soldering point for the braided outer conductor of a coaxial cable and the interior wire of a single conductor insulated wire as hereinafter described. Feature 106 is fork-shaped. The bracket 100 further comprises an anti rotation tab 110 and a mounting hole 112 to receive an appropriate threaded fastener.

Figure 13:
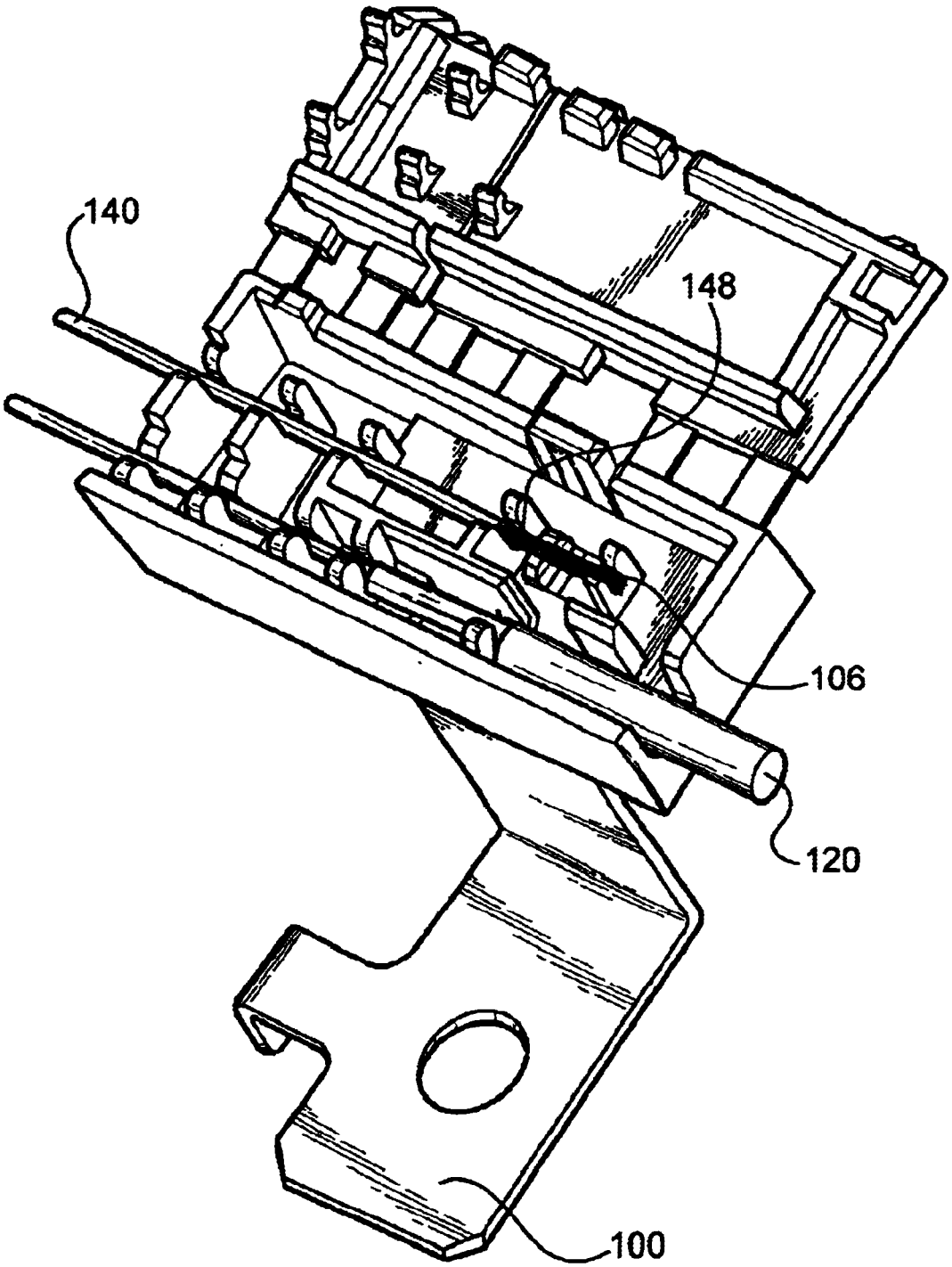
FIG. 13 is a perspective view of the FIG. 9 device after adding the second antenna wire.

Referring again to FIG. 9, the interior of the closure 70 is configured to define a coaxial cable-receiving location similar to that of FIG. 1, an antenna wire-receiving location similar to that of FIG. 1, and a soldering position defined by metal features 104 and 106. In addition, the closure 70 receives a second grounding wire 140 as shown in FIG. 13.

Figure 11:
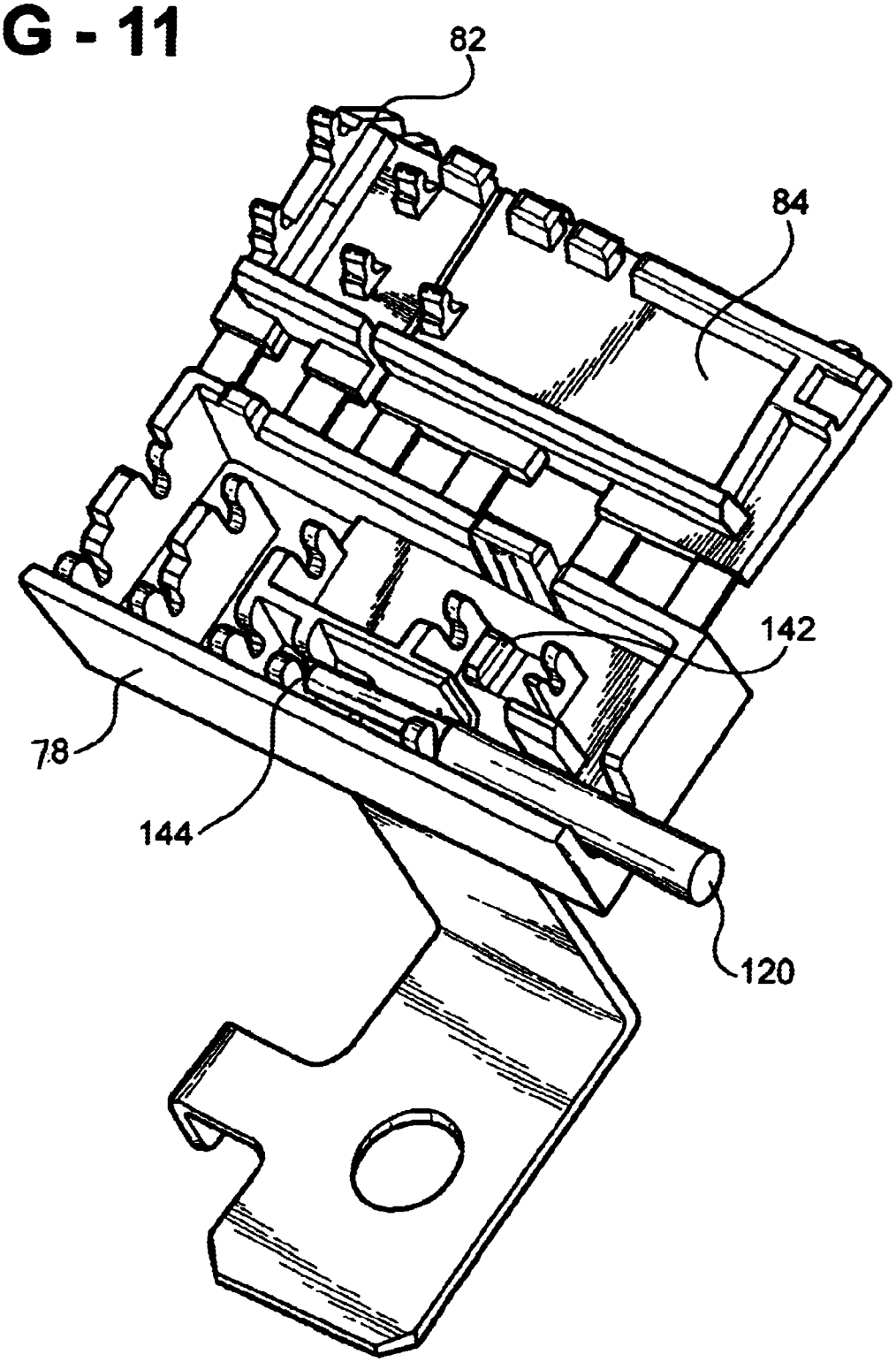
FIG. 11 is a perspective view of the FIG. 9 device with the coaxial cable press fit into the closure.

The coaxial cable receiving location is defined by a notch 118 in end wall 76, a longitudinal interior partition 114 and forks 122 and 123. The coaxial cable 120 is stripped as shown in FIG. 3 and pressed into place as shown in FIG. 11. Both covers 82, 84 are open.

Figure 9:
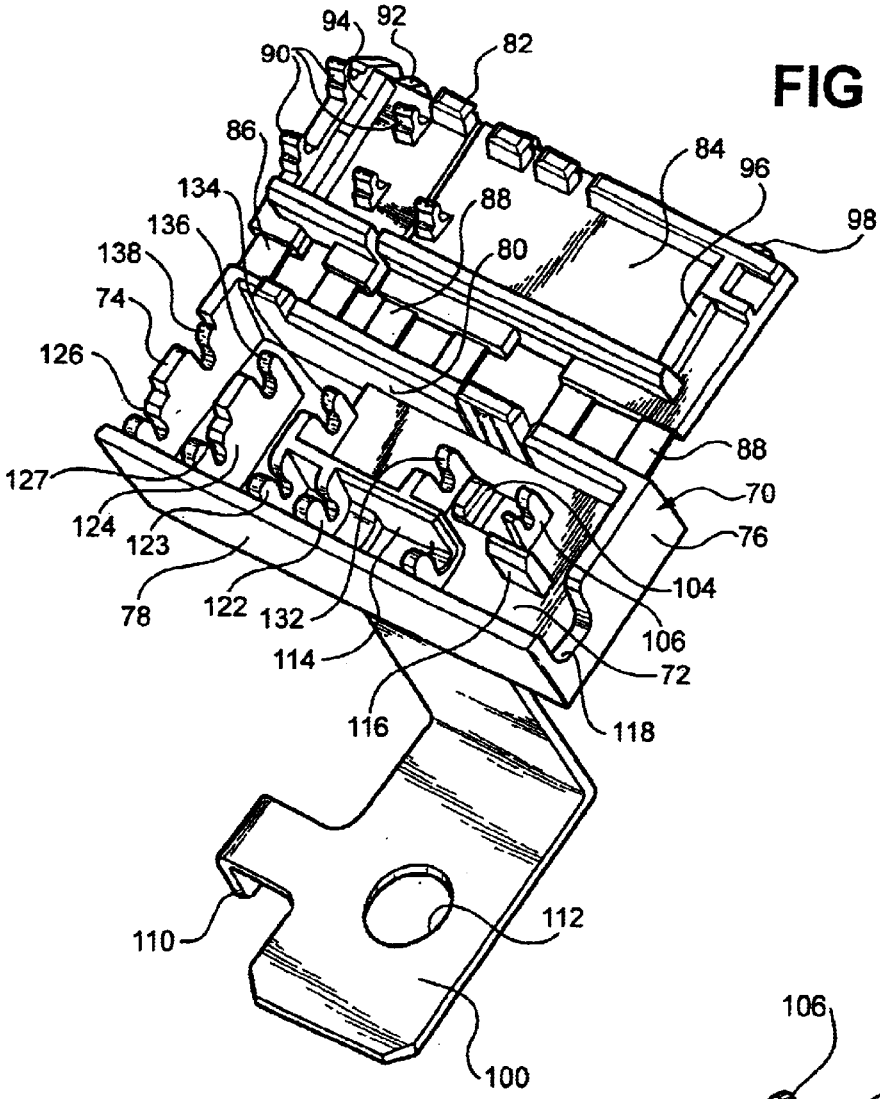
FIG. 9 is a perspective view of a closure and grounding bracket combination for splicing a coaxial cable to two insulated antenna wires and grounding one of the coaxial cables and one of the antenna wires.
Figure 12:
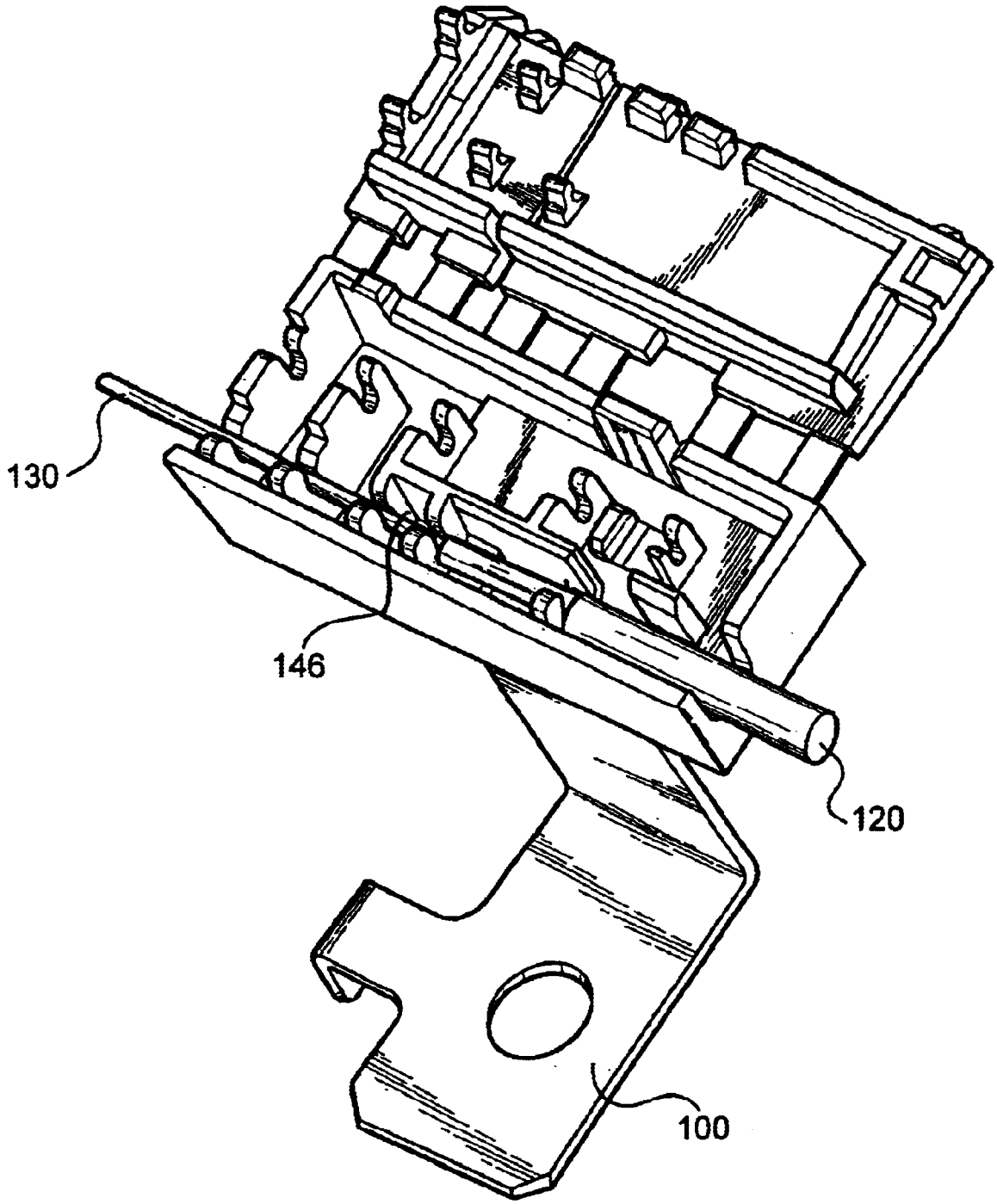
FIG. 12 is a perspective view of the FIG. 9 device after adding the first antenna wire.

The receiving location for antenna wire 130 is very similar to the corresponding location and structure in FIG. 1. In FIG. 9, a notch 126 in wall 74 lines up with a notch 127 in partition 124 and the outside notches in forks 122 and 123. Accordingly, the antenna wire 130 can be stripped and pressed into place as shown in FIG. 12. In this position, the antenna wire 130 is in opposite overlapping alignment with the end-stripped interior conductor of the coaxial cable 120 when it is in position within the notch 118 as shown in FIG. 11.

Additional notches 134, 136 and 138 are provided in the interior features of the closure 70 to provide a third wire-receiving location. In this case, a location for antenna ground wire 140 which is end-stripped for about 10 mm.

As before, the coaxial cable 120 is end-stripped to expose approximately 14 mm of the outer braided conductor 142 and approximately 4 mm of the internal conductor 144. The end-stripped coaxial cable is pressed into place as shown in FIG. 11 such that the unstripped portion is snugly received by the notch 118 in the end wall 76. The braided outer conductor 142 is pulled to one side and placed on a metal seat between the features 104 and 106 of the soldering fork on the bracket 100. The insulated length of the inner conductor is held between the interior wall 114 and the exterior wall 78 and the exposed inner conductor 144 is placed in the fork 122. Both covers 82 and 84 remain open.

Going now to FIG. 12 the next step is to strip the antenna wire 130 and lay it in the forks 122, 123 and notches 127 and 126 with the stripped end 146 in overlying contact with the stripped end of the inner conductor of the coaxial cable 120. The covers 82 and 84 remain open.

Going on to FIG. 13, the next step is to strip the ground wire 140 to provide an exposed conductor end 148 and lay the conductor into the third interior wire receiving location defined by the end wall notch 138 and the interior notches 136, 134 and 132. The ground wire 140 is located such that the exposed end conductor 148 is held in the soldering fork feature 106 and it overlies the braided outer conductor of the coaxial cable 120.

Figure 14:
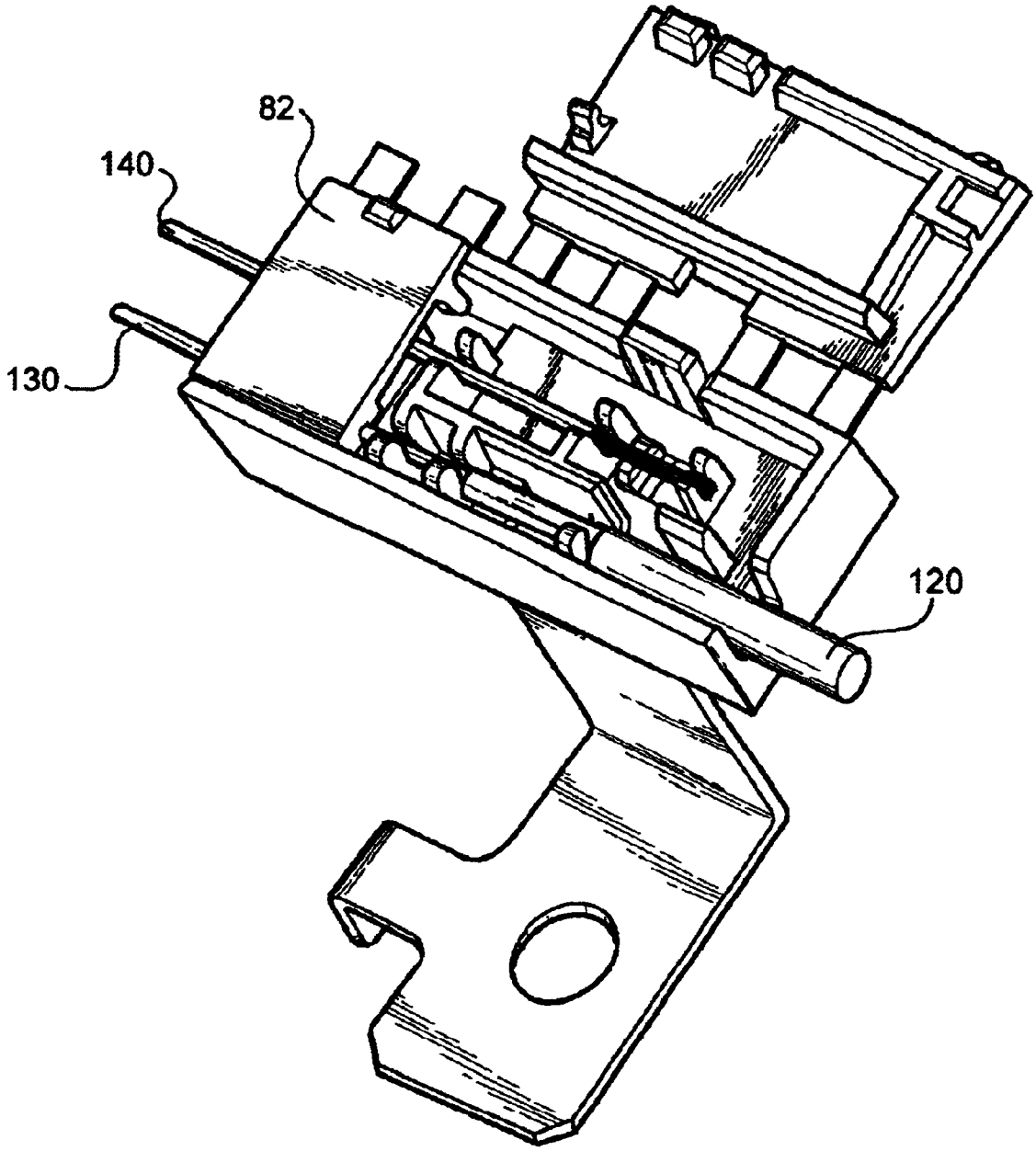
FIG. 14 is a perspective view of the FIG. 9 device after one cover has been closed to clamp the two antenna wires in place.

As shown in FIG. 14 the next step is to close the cover 82 to secure the wires 130 and 140 in place so that they do not move during the soldering operation.

Figure 15:
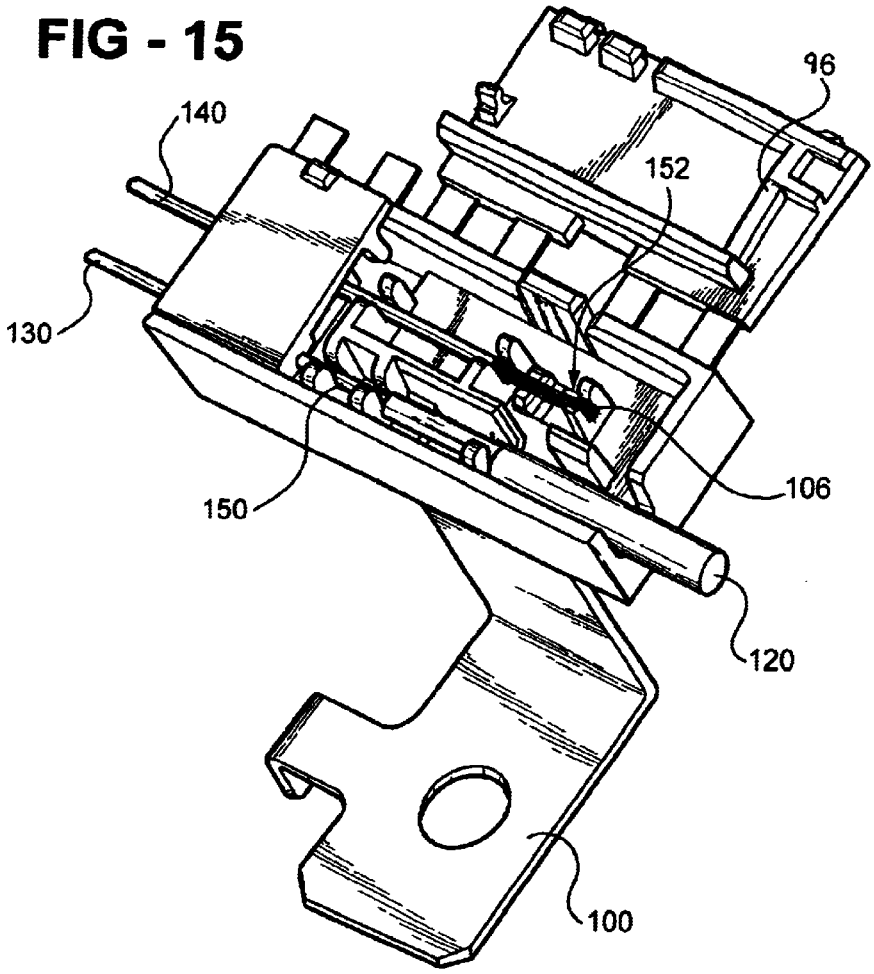
FIG. 15 is a view of the FIG. 9 device during the soldering operation.

As shown in FIG. 15 the next step is to apply solder to the contacting conductor point 150 and to the two-way ground point 152 adjacent the soldering fork 106. This joins or splices the inner conductor of the coaxial cable 120 to the conductor of the insulated wire 130 to complete a circuit. It also grounds the antenna ground wire 140 and the outer braided conductor of the coaxial cable 120 to the grounding bracket 100.

Figure 16:
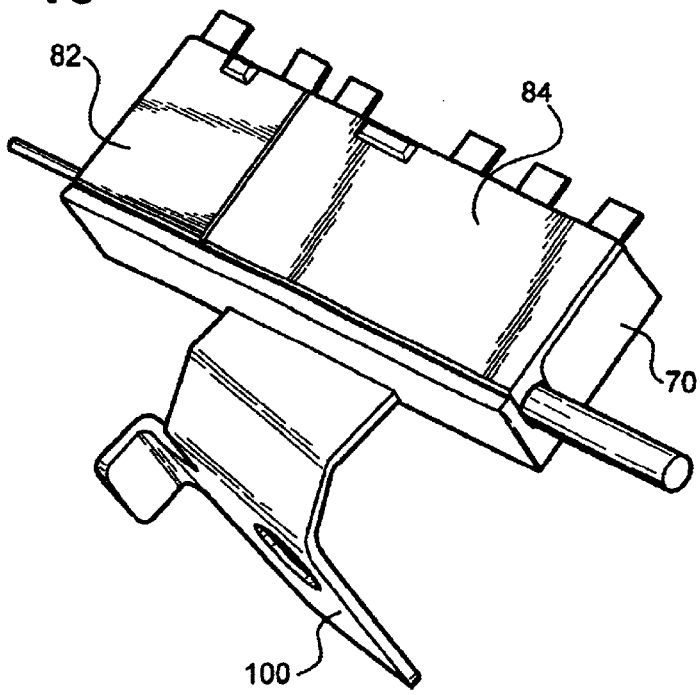
FIG. 16 is a view of the FIG. 9 device after the second clamping cover has been closed.

Looking to FIG. 16 the final step is to close and lock the cover 84 to bring the clamping bar 96 into contact with the outer jacket of the coaxial cable 120 to hold that cable in place and prevent tension from reaching the solder points.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims. For example, it will be apparent to persons skilled in the art that the specific design of the embodiments disclosed and described herein in detail can vary as to shape, size, number of conductors and so forth. While insert molding has been described as a preferred construction method for the devices disclosed herein, other procedures for joining metal to plastic can also be used. The term "box" is not to be construed as defining a specific rectangular geometry since other closure geometries can also obviously be used. The hinge points of the covers need not be coaxial or even parallel. Soldering is used in the application as a generic term to describe electrical and mechanical bonding and is intended to cover other techniques such as brazing, welding and crimping.

What is claimed is:

1. A coaxial cable splice and grounding closure comprising:

a closure of non-conducting material having a floor and longitudinal and lateral surrounding side walls integral with the floor;

a grounding bracket of conductive material having a grounding portion embedded in the floor and an attachment portion extending externally of the closure;

a soldering member integral with the embedded portion of the bracket and protruding in an exposed condition into the closure interior;

first means integral with the closure for defining a coaxial cable receiving location within the closure proximate and parallel to a longitudinal side wall, the location being laterally adjacent but spaced from the soldering member;

second means integral with the closure for defining an insulated wire receiving location within the closure parallel to said longitudinal side wall and aligned with the coaxial cable receiving location;

a first cover for covering a portion of the closure including the coaxial cable receiving location; and a second cover for covering a portion of the closure including the insulated wire receiving location.

2. A coaxial cable splice and grounding closure as defined in claim 1 further comprising snap lock means coacting between said covers and said closure.

3. A coaxial cable splice and grounding closure as defined in claim 1 wherein at least a portion of the soldering member is fork-shaped.

4. A coaxial cable splice and grounding closure as defined in claim 1 wherein each of the first and second covers is hingedly connected to the closure and includes a laterally extending interior clamping bar which coacts with the first and second location defining means to clamp the cable and wire, respectively, within the closure when the covers are closed.

5. A coaxial cable splice and grounding closure as defined in claim 4 wherein the first cover is larger than the second cover.

6. A coaxial cable splice and grounding closure as defined in claim 1 wherein the first means comprises a notch in a lateral wall and a longitudinal internal wall integrally upstanding from the box floor.

7. A coaxial cable splice and grounding closure as defined in claim 6 wherein the second means comprises a notch in another lateral wall.

8. A coaxial cable splice and grounding closure comprising:

a box of non conducting material having a floor, opposite longitudinal and laterally surrounding side walls and first and second longitudinally spaced covers hingedly attached to said side walls;

a grounding bracket of conductive material having a grounding portion embedded in the floor and an attachment portion extending externally of the box;

a soldering member integral with the embedded portion and protruding through the floor in an exposed condition into the interior of the box;

first means integral with the box for defining a coaxial cable receiving location in the box proximate and parallel to a longitudinal side wall, the location being laterally adjacent and spaced from the soldering member;

second means integral with the box for defining a first insulated wire receiving location in the box parallel to said longitudinal side wall and aligned with the coaxial cable location; and third means integral with the box for defining a second insulated wire receiving location in the box parallel to the first insulated wire receiving location but laterally spaced therefrom to line up with the soldering member, wherein the first cover overlies the first location defining means and the second cover overlies the second and third location defining means.

9. A coaxial cable splice and grounding closure as defined in claim 8 wherein each of the first and second covers includes a laterally extending interior clamping bar which coacts with the first and second location defining means to clamp the cable and wire, respectively, in the box when the covers are closed.

10. A coaxial cable splice and grounding closure as defined in claim 8 wherein the first means comprises a notch in a lateral box wall and a longitudinal internal wall integrally upstanding from the box floor.

11. A coaxial cable splice and grounding closure as defined in claim 8 wherein the second means comprises a notch in another lateral box wall.

12. A coaxial cable splice and grounding closure as defined in claim 8 further comprising snap lock means coacting between said covers and said box.

13. A coaxial cable splice and grounding closure as defined in claim 8 wherein the soldering member is fork-shaped.

14. A coaxial cable splice and grounding closure as defined in claim 8 wherein the first cover is larger than the second cover.

15. A method of splicing the inner conductor of a coaxial cable to an insulated wire and grounding the braided outer conductor of the coaxial cable comprising the steps of:

a. providing a closure of non-conducting material having a floor, longitudinal and lateral surrounding side walls and first and second longitudinally spaced covers, said closure further comprising a grounding bracket of conductive material having a grounding portion embedded in the floor of the closure and an attachment bracket extending externally of the closure; said closure further comprising a soldering member integral with the embedded portion of the bracket and extending through the floor in an exposed condition into the interior of the closure;

b. placing an end-stripped coaxial cable in a first location in the closure proximate and parallel to a longitudinal side wall;

c. stripping a portion of the braided outer conductor of the coaxial cable and placing it in contact with the soldering member;

d. placing a length of end-stripped insulated wire in a second location in the closure parallel to said longitudinal side wall and in contacting alignment with the inner conductor of the coaxial cable;

e. closing one of-the covers to clamp the insulated wire in position in the closure;

f. soldering the end stripped portion of the insulated wire to the inner conductor of the end stripped cable in the closure;

g. soldering the braided outer conductor of the coaxial cable to the soldering member; and h. closing the second cover to clamp the coaxial cable in position in the closure.

* * * * *